US008403777B1

(12) United States Patent
Huang

(10) Patent No.: US 8,403,777 B1
(45) Date of Patent: Mar. 26, 2013

(54) ARROW INSERT WITH AN UNDERCUT HEAD

(76) Inventor: Dorge O'some Huang, Henry, IL (US)

( * ) Notice: Subject to any disclaimer, the term of this patent is extended or adjusted under 35 U.S.C. 154(b) by 0 days.

(21) Appl. No.: 13/298,255

(22) Filed: Nov. 16, 2011

(51) Int. Cl.
*F42B 6/04* (2006.01)

(52) U.S. Cl. ..... 473/582

(58) Field of Classification Search ..... 473/578, 473/582, 583
See application file for complete search history.

(56) References Cited

U.S. PATENT DOCUMENTS 5,636,846 A * 6/1997 Tinsley ..... 473/584
5,921,875 A * 7/1999 Bickel ..... 473/582
7,004,859 B2 * 2/2006 Palomaki et al. ..... 473/578
7,115,055 B2 * 10/2006 Palomaki et al. ..... 473/578
7,651,421 B2 * 1/2010 Smith et al. ..... 473/582
8,057,330 B2 * 11/2011 Blosser et al. ..... 473/582

* cited by examiner

*Primary Examiner* — John Ricci
(74) *Attorney, Agent, or Firm* — Donald J. Ersler

(57) ABSTRACT

An arrow insert is inserted into an arrow shaft. The arrow insert includes an outer end with a head, which is located against a leading end of the arrow shaft. An interior diameter of the arrow insert is machined as to accept a threaded arrow tip. To assemble the arrow insert with the arrow, the neck of the arrow insert is coated with an adhesive and inserted into the arrow shaft. The head of the arrow insert has an angular undercut, which is substantially concave. The angular cut of the head is a mating surface for an angular cut on the leading end of the arrow shaft. The substantial concave surface of the arrow insert and the substantial convex surface of the arrow tube prevents the rearward movement of the arrow insert, and the mushrooming of the leading end of the arrow shaft.

13 Claims, 1 Drawing Sheet

ARROW INSERT WITH AN UNDERCUT HEAD

BACKGROUND OF THE INVENTION

1. Field of the Invention

The present invention relates generally to archery arrows and more specifically to an arrow insert with undercut head.

2. Discussion of the Prior Art

Historically there have been many advancements in the art of archery. From the earliest time when man first affixed a flint point to the end of a slender stick, and propelled it form a bow, he has strived to increase the performance and accuracy of the arrow. New materials with greater strength, lighter weight projectiles, and aerodynamic vanes have all helped to increase performance, but there has always been an issue with dynamic forces on the arrow itself, and the consistent alignment of the arrow tip.

The present invention takes arrow performance to an all new level, by strengthening the forward end of the arrow shaft itself.

Prior art of an arrow point has been good at best, where the neck of the point and the threads might be off concentrically from the arrow insert, of the tip itself. All the archer could hope for was to screw the arrow tip into the arrow insert, and hope that they would align well enough to make the arrow fly with acceptable accuracy. More recently, an O-ring was slid on the neck of some arrow tips. This O-ring was compressed between the base of the arrow tip and the arrow insert. Though this helped alignment ever so slightly, it offered no long term solution, as the arrow tip could still be mis-aligned.

Another problem associated with high powered bows and standard style inserts is that when an arrow shaft is cut perpendicular to its length, a weakness is created at the most critical point, the end that impacts the target. When an arrow insert is positioned at the end of an arrow shaft, upon impact, these extreme forces are applied to the end of the shaft at its weakest point. Since the end of the shaft is flat, and the collar on the insert is flat, these forces are allowed to go out radially form the arrow, causing the front end of the arrow shaft to mushroom as the arrow insert is forced backwards.

The present invention strengthens the forward end of an arrow by cutting the front end of the arrow shaft at an angle, and machining the collar on the insert at an angle to mate with said shaft end, the pressure from impact is confined, thus eliminating the mushrooming effect of standard style inserts and arrow shafts that are cut of perpendicular to the length of the shaft.

SUMMARY OF THE INVENTION

An arrow insert with undercut head includes a front end, a rear end, a mid section, and an interior. An interior of an arrow insert is most commonly designed to accept a threaded arrow tip. The arrow insert is most commonly adhesively inserted into the leading end of an arrow shaft. The arrow shaft is a tube and includes an outer shaft diameter, an interior shaft diameter, and a wall thickness. The arrow insert is inserted into the arrow shaft. The arrow insert includes an outer end with a head, which is located against a leading end of the arrow shaft. An outer diameter of the head is generally consistent with the outer diameter of the arrow shaft. The neck of the arrow insert is of a diameter that is smaller than an interior diameter of the arrow shaft. An interior diameter of the arrow insert is machined to accept a threaded arrow tip. To assemble the arrow insert with the arrow, the neck of the arrow insert is coated with an adhesive and inserted into the arrow shaft, until a collar of the arrow insert contacts an angular cut of the leading end of the arrow shaft. The head of the arrow insert has the angular cut, which is substantially concave, as opposed to being perpendicular in relationship to the outer end of the arrow insert The angular cut of the head is a mating surface for an angular cut on the leading end of the arrow shaft. By making the head of the arrow insert substantially concave, and making the leading end of the arrow shaft substantially convex, the surface area of these two surfaces is increased, making for a much stronger connection between the insert and the arrow shaft, which in turn, prevents the rearward movement of the arrow insert, and the mushrooming of the leading end of the arrow shaft.

DESCRIPTION OF THE PREFERRED EMBODIMENTS

Figure 1:
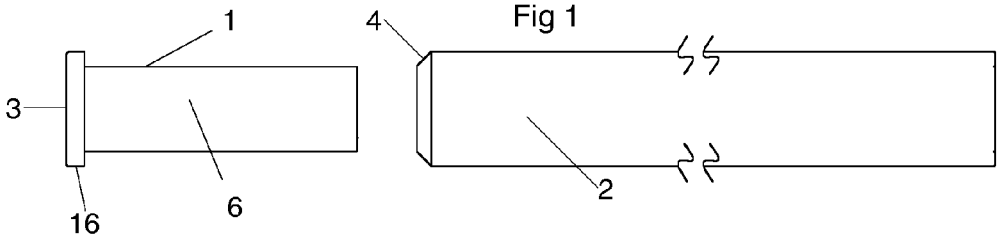
FIG. 1 is a view of arrow components of the present invention.
Figure 2:
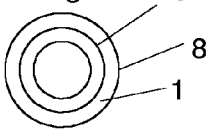
FIG. 2 is an end view of the arrow insert of the present invention
Figure 3:
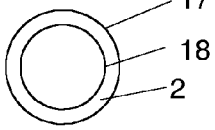
FIG. 3 is an end view of the arrow shaft of the present invention.
Figure 4A:
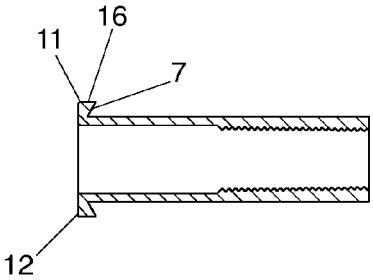
FIG. 4*a* is a standard version cross section of the components of the present invention.
Figure 4A:
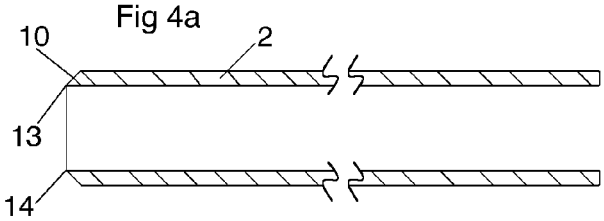
Figure 4B:
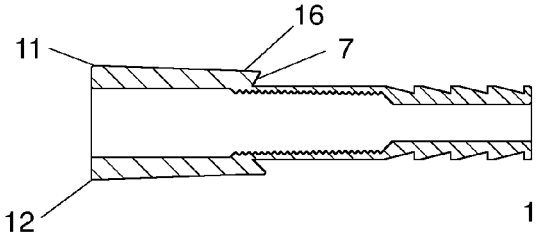
FIG. 4*b* is a narrow version cross section of the components of the present invention.
Figure 4B:
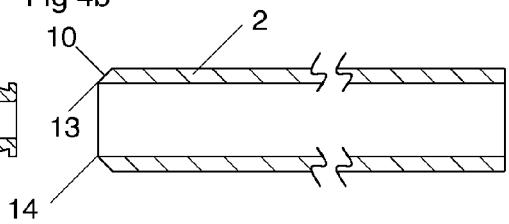

An arrow insert is generally a cylinder configuration, and an arrow shaft is generally a tubular configuration. An arrow insert would have a front end, a rear end, a mid section, and an interior. The interior is most commonly designed to accept a threaded arrow tip. The arrow insert is most commonly adhesively inserted into the leading end of an arrow shaft. An arrow shaft, being a tube, has an outer shaft diameter, an interior shaft diameter, and a wall thickness. In FIG. 1, shown are the two main components of the present invention. The arrow insert 1 is shown in an aligned position as to be inserted into the arrow shaft 2. The arrow insert 1 includes an outer end 3 with a head 16, which is generally positioned at the leading end 4 of an arrow shaft 2, and an opposing end 5, which is within the interior of the arrow shaft 2. FIG. 2, shown the cross section of the diameter of the insert 1. FIG. 3, shown the cross section of the arrow shaft 2.

Figure 5:
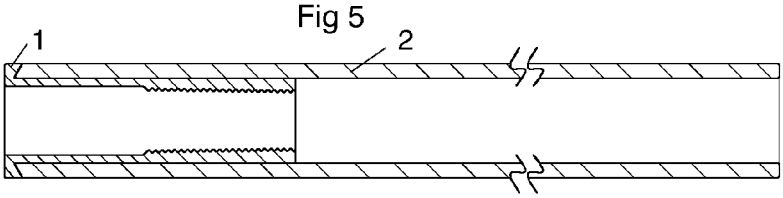
FIG. 5 is a cross section of the assembled components of the present invention.
Figure 6:
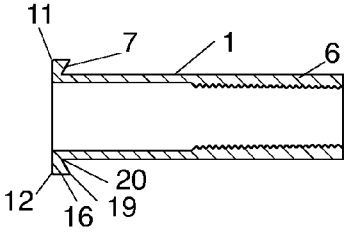
FIG. 6 is a cross section of the components of the present invention, wherein the mating surfaces of components are described.
Figure 6:
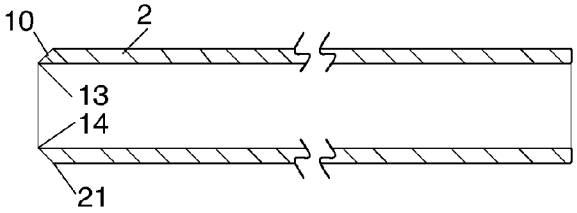

A diameter 8 of the outer end 3 of the insert 1 is generally consistent with the diameter 17 of the leading end 4 of the arrow shaft 2. The neck 6 of the arrow insert 1 is of a diameter that is smaller than the interior diameter 18 by at least 0.0005 inches, when measured in the cross section from point 13 to point 14, of the arrow shaft 2. In FIG. 4, a cross section of the components of the present invention is shown. The head 16 has an outer diameter 8 (from FIG. 1) which, when measured in a cross section from top point 11 to bottom point 12, and an interior 9 machined as to accept a threaded arrow tip. To assemble the arrow insert 1 with the arrow 2, the neck 6 of the arrow insert 1 is coated with an adhesive and inserted into the arrow shaft 2 until the angular undercut 7 of the insert 1 contacts the angular cut 10 of the leading end 4 of the arrow shaft 2. As shown in FIG. 4, FIG. 5, and FIG. 6, the head 16 of the arrow insert 1 has an angular undercut 7 that is substantially concave, as opposed to being perpendicular, in relationship to the outer end 3 of the insert 1. The angular undercut 7 of the head 16 is a mating surface for the angular cut 10 of the leading end 4 of the arrow shaft 2. A cross sectional shape of the angular undercut 7 and the angular cut 10 may be straight or curved. FIG. 6 shows with more detail, that the dimension, when measured from point 19 and 20 of the angular undercut 7 on the head 16 of the arrow insert 1, and the dimension of the angular cut 10, when measured from points 14 to 21, of the leading end 4 of the arrow shaft 2 is greater than the wall thickness of the arrow 2, when the wall thickness is measured between points 22 and 23. By making the head 16 of the insert 1 substantially concave, and making the leading end 4 of the arrow shaft 2 substantially convex, the surface area of these two surfaces is increased, making for a much stronger connection between the insert 1 and the arrow shaft 2, which in turn, prevents the rearward movement of the insert 1, and the mushrooming of the leading end 4 of the arrow shaft.

What I claim is:

1. An arrow insert with an undercut head, comprising:

an arrow insert having an outer perimeter and an inner perimeter, a head being formed on one end of said arrow insert, said head having a greater perimeter than said outer perimeter of said arrow insert, one end of said head being a first end of said arrow insert, an angular undercut is formed in the other end of said head to mate with one end of an arrow shaft, an outer perimeter of said arrow insert is sized to be received by an inner perimeter of the arrow shaft.

2. The arrow insert with an undercut head of claim 1 wherein:

a cross sectional shape of said angular undercut is one of straight and curved.

3. The arrow insert with an undercut head of claim 1 wherein:

said inner perimeter of said arrow insert is adapted to retain an arrow tip.

4. The arrow insert with an undercut head of claim 1 wherein:

said outer perimeter of said arrow insert is at least 0.0005 inches less than the inner perimeter of the arrow shaft.

5. The arrow insert with an undercut head of claim 1 wherein:

an angular cut is formed on the one end of the arrow shaft, the angular cut is sized to be received by said angular undercut.

6. An arrow insert with an undercut head, comprising:

an arrow insert having an outer perimeter and an inner perimeter, a head being formed on one end of said arrow insert, said head having a greater perimeter than said outer perimeter of said arrow insert, one end of said head being a first end of said arrow insert, a substantially concave undercut is formed in the other end of said head to mate with one end of an arrow shaft, an outer perimeter of said arrow insert is sized to be received by an inner perimeter of the arrow shaft.

7. The arrow insert with an undercut head of claim 6 wherein:

said inner perimeter of said arrow insert is adapted to retain an arrow tip.

8. The arrow insert with an undercut head of claim 6 wherein:

said outer perimeter of said arrow insert is at least 0.0005 inches less than the inner perimeter of the arrow shaft.

9. The arrow insert with an undercut head of claim 6 wherein:

a substantially convex cut is formed on the one end of the arrow shaft, the substantially convex cut is sized to be received by said substantially concave undercut.

10. An arrow insert with an undercut head, comprising:

an arrow insert having an outer perimeter and an inner perimeter, a head being formed on one end of said arrow insert, said head having a greater perimeter than said outer perimeter of said arrow insert, one end of said head being a first end of said arrow insert, a substantially concave undercut is formed in the other end of head to mate with one end of an arrow shaft, an outer perimeter of said arrow insert is sized to be received by an inner perimeter of the arrow shaft, wherein adhesive is applied between said outer perimeter of said arrow insert and the inner perimeter of the arrow shaft.

11. The arrow insert with an undercut head of claim 10 wherein:

said inner perimeter of said arrow insert is adapted to retain an arrow tip.

12. The arrow insert with an undercut head of claim 10 wherein:

said outer perimeter of said arrow insert is at least 0.0005 inches less than the inner perimeter of the arrow shaft.

13. The arrow insert with an undercut head of claim 10 wherein:

a substantially convex cut is formed on the one end of the arrow shaft, the substantially convex cut is sized to be received by said substantially concave undercut.

* * * * *